US011198291B2

(12) United States Patent
Tsuneoka et al.

(10) Patent No.: US 11,198,291 B2
(45) Date of Patent: Dec. 14, 2021

(54) DROPLET EJECTING DEVICE THAT SELECTIVELY USES PRESCRIBED COMBINATIONS OF NOZZLES IN ACCORDANCE WITH EJECTION QUANTITY OF LIQUID

(71) Applicant: Brother Kogyo Kabushiki Kaisha, Nagoya (JP)

(72) Inventors: Yuya Tsuneoka, Nagoya (JP); Takaichiro Umeda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/009,345

(22) Filed: Sep. 1, 2020

(65) Prior Publication Data

US 2020/0398560 A1 Dec. 24, 2020

Related U.S. Application Data

(63) Continuation of application No. PCT/JP2019/010498, filed on Mar. 14, 2019.

(30) Foreign Application Priority Data

Mar. 30, 2018 (JP) ..... JP2018-070121

(51) Int. Cl.
*B41J 2/045* (2006.01)
*B41J 2/14* (2006.01)
*B41J 2/155* (2006.01)

(52) U.S. Cl.
CPC ..... *B41J 2/04581* (2013.01); *B41J 2/04563* (2013.01); *B41J 2/14201* (2013.01); *B41J 2/155* (2013.01)

(58) Field of Classification Search
CPC .. B41J 2/2132; B41J 2/04581; B41J 2/04573; B41J 29/38; B41J 2/155; B41J 2/04563;
(Continued)

(56) References Cited

U.S. PATENT DOCUMENTS 9,010,897 B2 4/2015 Tanase et al.
9,358,779 B2 6/2016 Miyazaki et al.
(Continued)

FOREIGN PATENT DOCUMENTS

JP 2012-166477 A 9/2012
JP 2013-237167 A 11/2013
(Continued)

OTHER PUBLICATIONS

Oct. 6, 2020—International Preliminary Report on Patentability—Intl App PCT/JP2019/010498, Eng Tran.
(Continued)

*Primary Examiner* — Jannelle M Lebron
(74) *Attorney, Agent, or Firm* — Banner & Witcoff, Ltd.

(57) ABSTRACT

A droplet ejecting device includes: a first nozzle group consisting of N pieces of first nozzles aligned in a first direction; a second nozzle group consisting of N pieces of second nozzles aligned in the first direction and at the same positions in the first direction as the first nozzles; and a controller. The controller is configured to determine whether an ejection quantity per unit time is not smaller than a first threshold. When the ejection quantity is equal to or greater than the first threshold, a first combination of N pieces of nozzles from among the N pieces of first nozzles and the N pieces of second nozzles is selected. When the ejection quantity is smaller than the first threshold, a second combination of N pieces of nozzles from among the N pieces of first nozzles and the N pieces of second nozzles is selected.

13 Claims, 12 Drawing Sheets

(58) Field of Classification Search
CPC .... B41J 2/14201; B41J 2202/21; B41J 2/135; B41J 2/14
See application file for complete search history.

(56) References Cited

U.S. PATENT DOCUMENTS

| | | | | |
|---|---|---|---|---|
| 9,827,794 | B2 * | 11/2017 | Miyamoto | B41J 2/2135 |
| 2007/0126771 | A1 | 6/2007 | Brown et al. | |
| 2010/0053238 | A1 * | 3/2010 | Suzuki | B41J 2/155 347/6 |
| 2012/0206525 | A1 | 8/2012 | Tanase et al. | |
| 2016/0114577 | A1 | 4/2016 | Miyazaki et al. | |
| 2017/0197409 | A1 | 7/2017 | Okushima et al. | |

FOREIGN PATENT DOCUMENTS

| | | | |
|---|---|---|---|
| JP | 2015-214130 | A | 12/2015 |
| JP | 2016-083882 | A | 5/2016 |
| JP | 2017-124619 | A | 7/2017 |

OTHER PUBLICATIONS

May 28, 2019—International Search Report—Intl App PCT/JP2019/010498.

* cited by examiner

| i | EJECTION QUANTITY THRESHOLD (ml/min) | NOZZLE COMBINATION |
|---|---|---|
| 0 | 24≦ | ISOLATED COMBINATION |
| 1 | 16≦ | OUTER COMBINATION |
| 2 | 16> | INNER COMBINATION |

DROPLET EJECTING DEVICE THAT SELECTIVELY USES PRESCRIBED COMBINATIONS OF NOZZLES IN ACCORDANCE WITH EJECTION QUANTITY OF LIQUID

CROSS REFERENCE TO RELATED APPLICATION

This application is a continuation application of PCT/JP2019/010498 filed Mar. 14, 2019 which claims priority from Japanese Patent Application No. 2018-070121 filed Mar. 30, 2018. The entire contents of these earlier applications are incorporated herein by reference.

TECHNICAL FIELD

The present disclosure relates to a droplet ejecting device that ejects droplets.

BACKGROUND

Japanese Patent Application Publication No. 2016-83882, for example, describes a recording device that uses all of six rows of nozzles to print at a high speed when the user has selected a "Fast Mode" and uses only the four center rows of nozzles to print with less density variation caused by uneven temperature distribution in the ink when the user has selected a "High-Quality Mode."

SUMMARY

However, ink flow in a print head varies according to the quantity of ink being ejected. For example, a larger quantity of ejected ink produces a higher negative pressure in the print head, causing ink to flow into the print head from both inlets and outlets of the head. Such changes in ink flow cause changes in the temperature distribution within ink in the head. In other words, the ejection quantity of ink produces uneven temperatures within ink present in the head.

Therefore, in order to suppress uneven density caused by uneven ink temperatures when executing image formation, it is necessary to consider how temperature unevenness in ink changes in response to changes in the quantity of ink ejected. However, the recording device in Patent Document 1 described above does not consider how uneven ink temperatures change in response to changes in ink ejection quantities.

In view of the foregoing, it is an object of the present invention to provide a droplet ejecting device that can suppress uneven ink density caused by uneven ink temperature by using ink (nozzles) with less unevenness in temperature in response to changes in temperature variation to account for variations in ink temperature caused by changes in the quantity of ink to be ejected.

In order to attain the above and other objects, according to an aspect, the present disclosure provides a droplet ejecting device including a first nozzle group, a second nozzle group, and a controller. The first nozzle group consists of N pieces of first nozzles aligned in a first direction. The second nozzle group consists of N pieces of second nozzles aligned in the first direction. The second nozzles in the second nozzle group are respectively at the same positions in the first direction as the first nozzles in the first nozzle group. The controller is configured to control an ejection quantity of liquid through the first nozzles and the second nozzles and determine whether the ejection quantity of the liquid per unit time is equal to or greater than a first threshold. The controller is configured to: select a first combination of N pieces in total of nozzles from among the N pieces of first nozzles and among the N pieces of second nozzles to be used for image formation in a case where the ejection quantity is equal to or greater than the first threshold; and select a second combination of N pieces in total of nozzles from among the N pieces of first nozzles and among the N pieces of second nozzles to be used for image formation in a case where the ejection quantity is smaller than the first threshold.

According to another aspect, the present disclosure also provides a method of controlling an ejection quantity of liquid through a first nozzle group and a second nozzle group of a droplet ejecting device. The first nozzle group consists of N pieces of first nozzles aligned in a first direction. The second nozzle group consists of N pieces of second nozzles aligned in the first direction. The second nozzles in the second nozzle group are respectively at the same positions in the first direction as the first nozzles in the first nozzle group. The method includes: determining whether the ejection quantity of the liquid per unit time is equal to or greater than a first threshold; selecting a first combination of N pieces in total of nozzles from among the N pieces of first nozzles and among the N pieces of second nozzles to be used for image formation in a case where the ejection quantity is equal to or greater than the first threshold; and selecting a second combination of N pieces in total of nozzles from among the N pieces of first nozzles and among the N pieces of second nozzles to be used for image formation in a case where the ejection quantity is smaller than the first threshold.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, a droplet ejecting device according to embodiments of the present invention will be described with reference to the drawings, when being applied to an inkjet printer as an exemplary example.

First Embodiment

Figure 1:
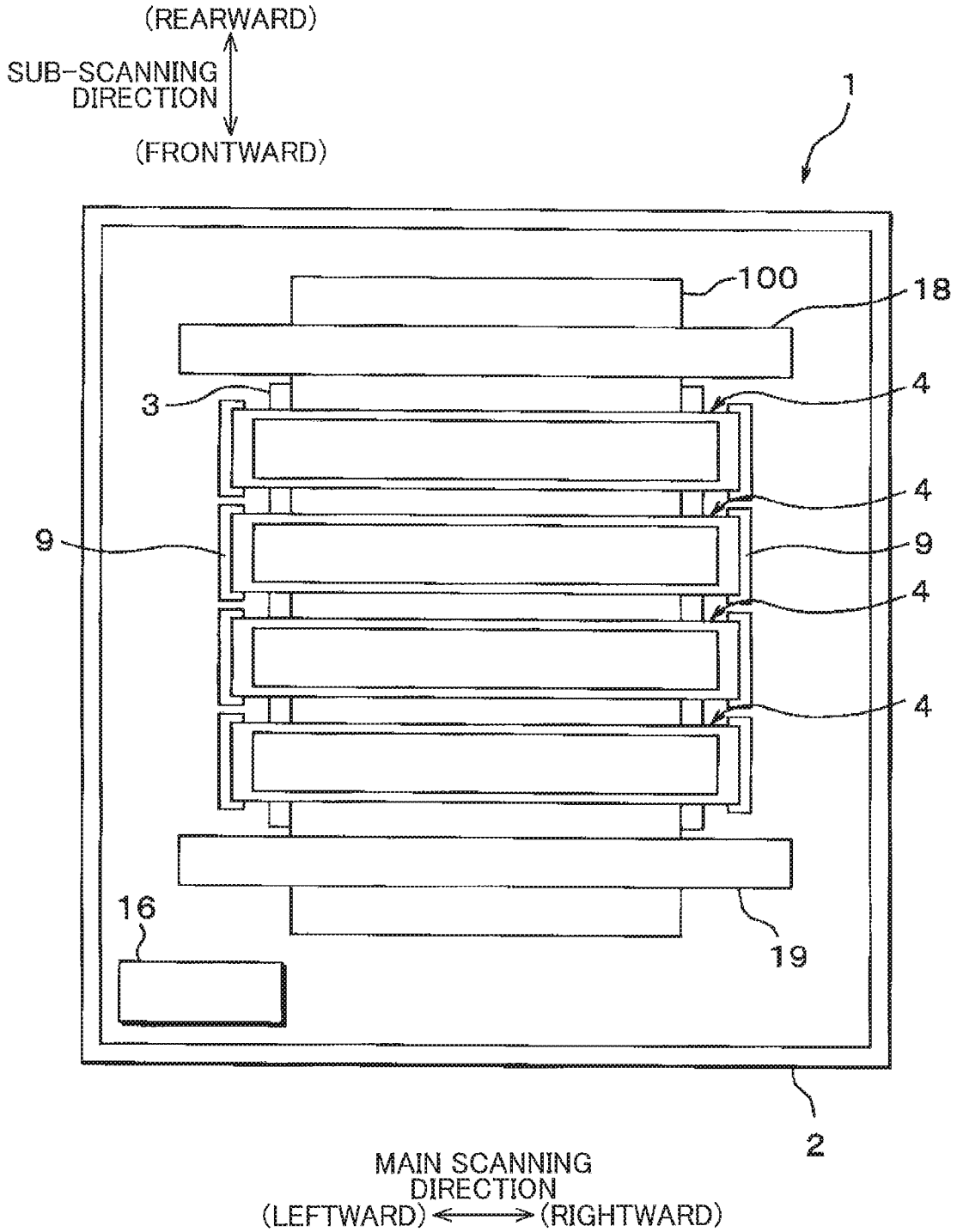
FIG. 1 is a schematic plan view illustrating an essential structure of an inkjet printer according to a first embodiment.

FIG. 1 is a schematic plan view illustrating an essential structure of an inkjet printer according to a first embodiment. In FIG. 1, the symbol "1" represents the inkjet printer according to the first embodiment.

As illustrated in FIG. 1, the inkjet printer 1 includes a conveying roller 18 and a conveying roller 19 for conveying a recording medium 100. The recording medium 100 is conveyed from the conveying roller 18 to the conveying roller 19. For the sake of convenience, in the following description, a conveying direction of the recording medium 100 will be called a sub-scanning direction. Further, in the inkjet printer 1, a downstream side in the sub-scanning direction is defined as a front side of the inkjet printer 1, and an upstream side in the sub-scanning direction is defined as a rear side of the inkjet printer 1.

Further, a direction crossing the sub-scanning direction is defined as a main scanning direction (left-right direction) of the inkjet printer 1. Additionally, a direction orthogonal to a surface of the recording medium 100 (the direction perpendicular to the paper surface of FIG. 1) will be defined as a vertical direction of the inkjet printer 1. That is, the side at which the sheet surface of FIG. 1 faces is upward, while the side at the back of the sheet surface of FIG. 1 is downward.

As shown in FIG. 1, in addition to the two conveying rollers 18 and 19 described above, the inkjet printer 1 includes a housing 2, a platen 3, four (for example) inkjet heads 4, and an ink cartridge 16.

The platen 3 is arranged horizontally in the housing 2 to support the recording medium 100 that is being is conveyed. The conveyed recording medium 100 is placed on a top surface of the platen 3.

The four inkjet heads 4 are arranged above the platen 3 and above the conveyed recording medium 100. The four inkjet heads 4 are juxtaposed in the sub-scanning direction.

The two conveying rollers 18 and 19 are arranged opposite to each other with the four inkjet heads 4 interposed therebetween in the sub-scanning direction. More specifically, the conveying roller 18 is disposed on the upstream side of the inkjet heads 4 in the sub-scanning direction, and the conveying roller 19 is disposed on the downstream side of the inkjet heads 4 in the sub-scanning direction. The conveying rollers 18 and 19 are driven by a motor (not shown) to convey the recording medium 100.

Each inkjet head 4 is a commonly referred to as a line head and is elongated in the main scanning direction. Each inkjet head 4 has a strip-like shape whose longitudinal direction is oriented in the main scanning direction. The inkjet heads 4 are individually fixed by head retaining parts 9. A plurality of nozzles is formed in a bottom surface of each inkjet head 4. The inkjet heads 4 are connected to the ink cartridge 16 by tubes 15 described later (see FIG. 3).

Figure 2:
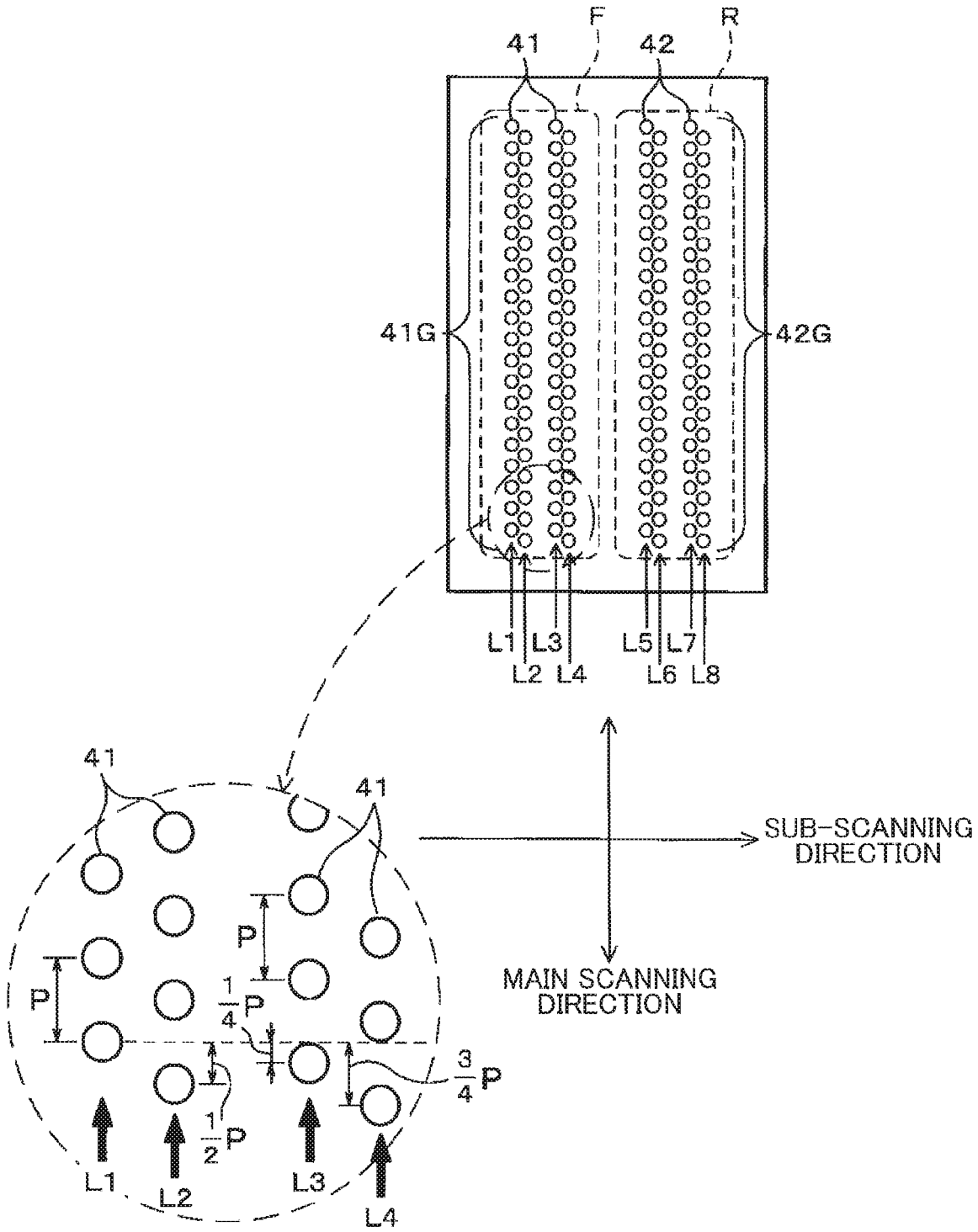
FIG. 2 is a bottom view illustrating a sample nozzle configuration when viewing an inkjet head according to the first embodiment from a bottom side thereof.

FIG. 2 is a bottom view illustrating a sample nozzle configuration when viewing the inkjet head 4 according to the first embodiment from a bottom side thereof. Pluralities of nozzles 41 and 42 are open in a nozzle surface (the bottom surface) of the inkjet head 4. In the following description, nozzles will also be used to refer to ejection openings in the nozzles 41 and 42. The nozzles 41 and 42 eject ink (liquid, droplets) supplied from the ink cartridge 16 toward the recording medium 100 on the platen 3.

The inkjet head 4 includes a front nozzle section F and a rear nozzle section R. The front nozzle section F has a first nozzle group 41G configured of N pieces of nozzles 41 (first nozzles) aligned in the main scanning direction (first direction). The rear nozzle section R has a second nozzle group 42G configured of N pieces of nozzles 42 (second nozzles) aligned in the main scanning direction. The first nozzle group 41G and second nozzle group 42G have the same formation and include pluralities of nozzles juxtaposed in the sub-scanning direction. Here, N is 80, for example.

The first nozzle group 41G has four nozzles rows L1, L2, L3, and L4. The nozzles rows L1-L4 are juxtaposed in the sub-scanning direction (the conveying direction). The nozzles rows L1-L4 are arranged in the order L1, L2, L3, and L4 in the sub-scanning direction. The nozzles 41 belonging to each of the nozzle rows L1, L2, L3, and L4 are aligned in the main scanning direction (a width direction of the paper) and are spaced apart from one another at a pitch P.

The nozzles 41 in the nozzle row L2 are arranged at positions shifted P/2 in the main scanning direction from the nozzles 41 in the nozzle row L1. Further, the nozzles 41 in the nozzle row L3 are arranged at positions shifted P/4 in the main scanning direction from the nozzles 41 in the nozzle row L1. Further, the nozzles 41 in the nozzle row L4 are arranged at positions shifted P/2 in the main scanning direction from the nozzles 41 in the nozzle row L3. Hence, the nozzles 41 in the nozzle row L4 are shifted (¾)×P in the main scanning direction from the nozzles 41 in the nozzle row L1.

The second nozzle group 42G has four nozzle rows L5, L6, L7, and L8. The nozzle rows L5-L8 are juxtaposed in the sub-scanning direction. The nozzle rows L5-L8 are arranged in the order L5, L6, L7, and L8 in the sub-scanning direction. The nozzles 42 belonging to each of the nozzle rows L5, L6, L7, and L8 are aligned in the main scanning direction and spaced apart from one another at the pitch P. The nozzles 42 in the nozzle row L6 are arranged at positions offset P/2 in the main scanning direction from the nozzles 42 in the nozzle row L5. Further, the nozzles 42 in the nozzle row L7 are arranged at positions offset P/4 in the main scanning direction from the nozzles 42 in the nozzle row L5. Further, the nozzles 42 in the nozzle row L8 are arranged at positions offset P/2 in the main scanning direction from the nozzles 42 in the nozzle row L7. In other words, the nozzles 42 in the nozzle row L8 are offset by (¾)×P in the main scanning direction from the nozzles 42 in the nozzle row L5.

In the following description, a nozzle group configured of the nozzles 41 in the two nozzle rows L1 and L2 will be called a nozzle group L11. Similarly, a nozzle group configured of the nozzles 41 in the two nozzle rows L3 and L4 will be called a nozzle group L12. Similarly, a nozzle group configured of the nozzles 42 in the two nozzle rows L5 and L6 will be called a nozzle group L13. Similarly, a nozzle group configured of the nozzles 42 in the two nozzle rows L7 and L8 will be called a nozzle group L14.

Note that the present embodiment is not limited to this arrangement. An inkjet head 4 having only the first nozzle group 41G and an inkjet head 4 having only the second nozzle group 42G may be arranged adjacent to each other in the sub-scanning direction.

The inkjet head 4 also includes the same number of actuators (not shown) as the nozzles 41 and 42. Note that the nozzles 41 and 42 are illustrated schematically for convenience, but the actual arrangement and number of nozzles are not limited to the example in FIG. 2.

Figure 3:
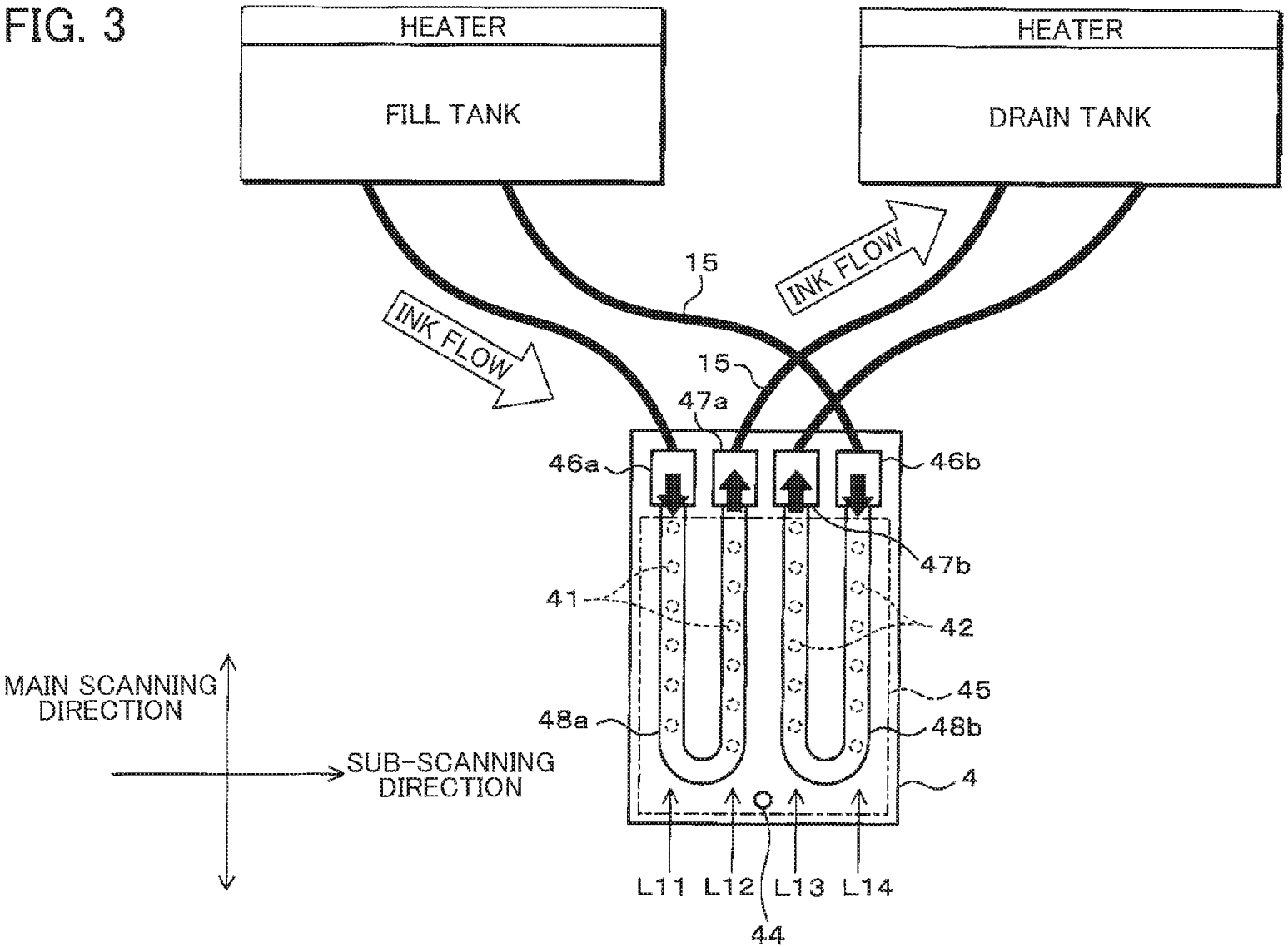
FIG. 3 is a schematic diagram illustrating common liquid chambers for ink in the inkjet head according to the first embodiment.

FIG. 3 is a schematic diagram illustrating common liquid chambers for ink in the inkjet head 4 according to the first embodiment. In FIG. 3, the inkjet head 4 is illustrated with a reduced number of the nozzles 41 and 42, and the structure of the inkjet head 4 is represented schematically for convenience of description. Further, black arrows indicate the flow of ink in FIG. 3.

Ink flows into the inkjet head 4 from a fill tank and flows out of the inkjet head 4 to a drain tank. The internal pressure of the fill tank is −1 kPa, while the internal pressure of the drain tank is −3 kPa, for example. Due to this pressure difference, ink flows from the fill tank to the drain tank through the inkjet head 4.

The inkjet head 4 has common liquid chambers 48*a* and 48*b* in which ink flows. For convenience, the inkjet head 4 will be described as having two common liquid chambers, i.e., a first common liquid chamber 48*a* for the nozzles 41 and a second common liquid chamber 48*b* for the nozzles 42.

The fill tank and the drain tank have heaters, respectively. The fill tank supplies ink heated to a prescribed temperature to the inkjet head 4, and the drain tank heats ink discharged from the inkjet head 4 to a prescribed temperature.

The inkjet head 4 has a first supply opening 46*a* and a second supply opening 46*b* for receiving the ink supplied from the fill tank. The inkjet head 4 also has a first discharge opening 47*a* and a second discharge opening 47*b* for discharging the ink to the drain tank. The first supply opening 46*a*, second supply opening 46*b*, first discharge opening 47*a*, and second discharge opening 47*b* are juxtaposed in the sub-scanning direction on one end portion of the inkjet head 4 in the main scanning direction.

The first supply opening 46*a* and second supply opening 46*b* are respectively provided on both sides (outer sides) of the inkjet head 4 in the sub-scanning direction. The first discharge opening 47*a* and second discharge opening 47*b* are provided between (inside of) the first supply opening 46*a* and second supply opening 46*b*. Accordingly, ink from the fill tank flows from the outside of the inkjet head 4 toward the inside thereof.

The first common liquid chamber 48*a* is formed in a U-shape and connects the first supply opening 46*a* to the first discharge opening 47*a*. The second common liquid chamber 48*b* is formed in a U-shape and connects the second supply opening 46*b* to the second discharge opening 47*b*. The first supply opening 46*a*, the first discharge opening 47*a*, the second supply opening 46*b* and the second discharge opening 47*b* are aligned (arranged in line) in the sub-scanning direction. The first common liquid chamber 48*a* is in communication with the N pieces of nozzles 41, for example, and the second common liquid chamber 48*b* is in communication with the N pieces of nozzles 42, for example.

The nozzles 41 in the first common liquid chamber 48*a* are divided into: the nozzle group L11 configured of a plurality of the nozzles 41 juxtaposed with the first supply opening 46*a* in the main scanning direction; and the nozzle group L12 configured of a plurality of the nozzles 41 juxtaposed with the first discharge opening 47*a* in the main scanning direction. The nozzle group L11 depicts the two nozzle rows L1 and L2 in FIG. 2 as a single row for simplification. The nozzle group L12 depicts the two nozzle rows L3 and L4 in FIG. 2 as a single row for simplification.

The nozzles 42 in the second common liquid chamber 48*b* are divided into: the nozzle group L13 configured of a plurality of the nozzles 42 juxtaposed with the second discharge opening 47*b* in the main scanning direction; and the nozzle group L14 configured of a plurality of the nozzles 42 juxtaposed with the second supply opening 46*b* in the main scanning direction. The nozzle group L13 depicts the two nozzle rows L5 and L6 in FIG. 2 as a single row for simplification. The nozzle group L14 depicts the two nozzle rows L7 and L8 in FIG. 2 as a single row for simplification.

The nozzles 41 in the nozzle group L11 are arranged at the same positions in the main scanning direction as the nozzles 42 in the nozzle group L13, and the nozzles 41 in the nozzle group L12 are arranged at the same positions in the main scanning direction as the nozzles 42 in the nozzle group L14. On the other hand, the nozzles 41 in the nozzle group L11 are arranged respectively at different positions in the main scanning direction from the nozzles 41 in the nozzle group L12, and the nozzles 42 in the nozzle group L13 are arranged respectively at different positions in the main scanning direction from the nozzles 42 in the nozzle group L14.

Specifically, spacing between the nozzles 41 in the nozzle group L11 is equivalent to spacing between the nozzles 41 in the nozzle group L12 in the main scanning direction, but the nozzles 41 in the nozzle group L12 are disposed at positions offset in the main scanning direction from the nozzles 41 in the nozzle group L11.

Further, spacing between the nozzles 42 in the nozzle group L13 is equivalent to spacing between the nozzles 42 in the nozzle group L14 in the main scanning direction, but the nozzles 42 in the nozzle group L14 are arranged at positions offset in the main scanning direction from the nozzles 42 in the nozzle group L13.

A sheet-like heater 45 is provided on the top surface and/or bottom surface of the inkjet head 4 so as to cover the common liquid chambers 48*a* and 48*b*. The heater 45 applies heat to the ink flowing in the common liquid chambers 48*a* and 48*b*.

A temperature sensor 44 is provided in a center part of the inkjet head 4 in the sub-scanning direction on the other end portion of the inkjet head 4 in the main scanning direction. The temperature sensor 44 is provided to detect the internal temperature of the inkjet head 4. The temperature sensor 44 is disposed in an intermediate area along the overall U-shaped lengths of the common liquid chambers 48*a* and 48*b*. In other words, the temperature sensor 44 is positioned opposite to the first supply opening 46*a* and the first discharge opening 47*a* with respect to the N pieces of nozzles 41 in the main scanning direction, and opposite to the second supply opening 46*b* and the second discharge opening 47*b* with respect to the N pieces of nozzles 42 in the main scanning direction. Hence, the temperature sensor 44 can detect an average temperature of the ink in the common liquid chambers 48*a* and 48*b*. Additionally, a control unit 61 described later can maintain the heater 45 at a prescribed target temperature based on detection results from the temperature sensor 44.

Figure 4:
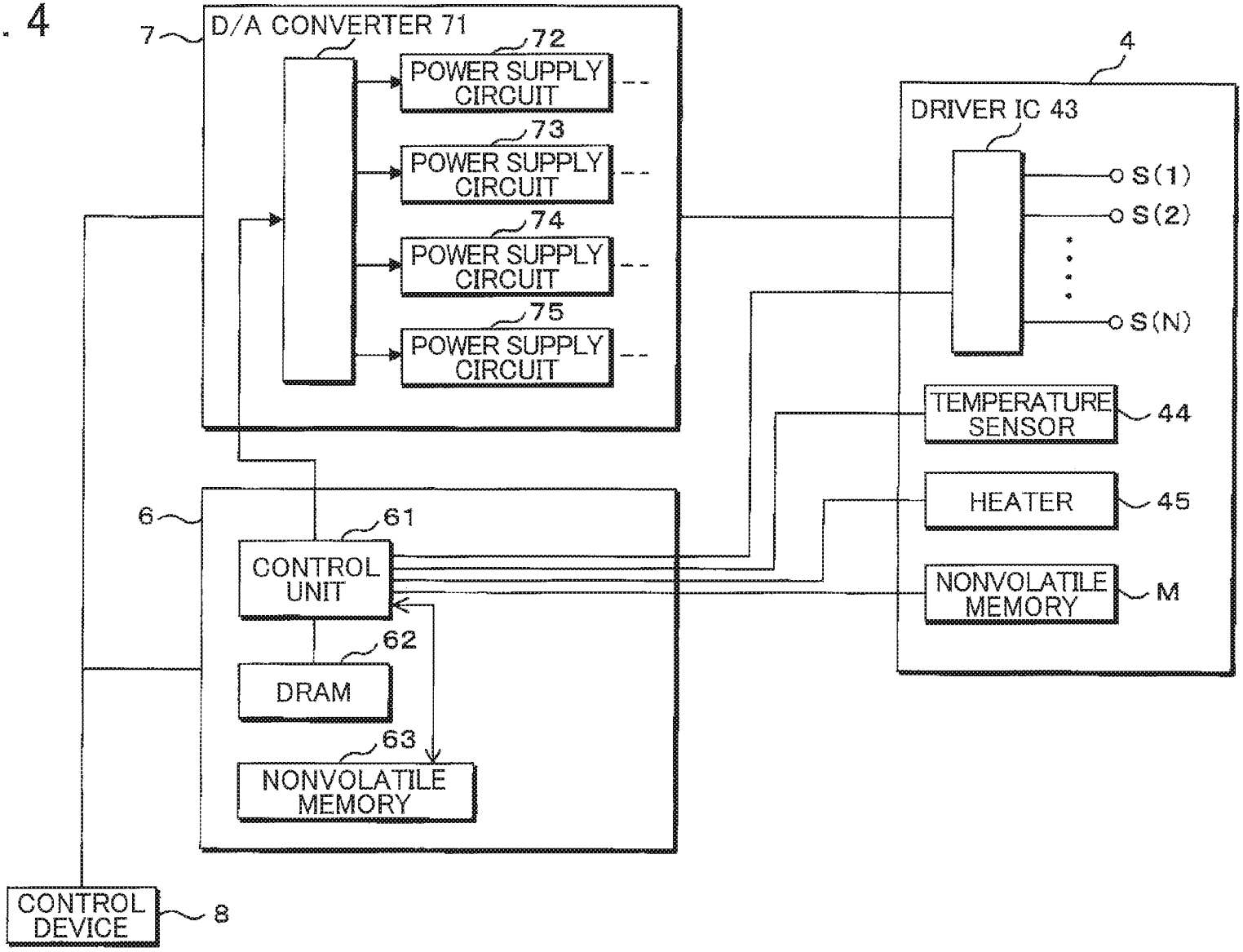
FIG. 4 is a block diagram illustrating an example of a primary electrical configuration in the inkjet head according to the first embodiment.

FIG. 4 is a block diagram illustrating an example of an essential electrical configuration for the inkjet head 4 of the first embodiment. A control board 6 and a power board 7 are connected to the inkjet head 4. The control board 6 and power board 7 are also connected to a control device 8.

The control board 6 includes: the control unit 61, such as a FPGA; a nonvolatile memory 63, such as EEPROM; a DRAM 62 for temporarily storing image data received from the control device 8; and the like. The power board 7 includes a D/A converter 71, a plurality of power supply circuits 72-75, and the like.

The inkjet head 4 also includes: a nonvolatile memory M, such as EEPROM; a driver IC 43; the temperature sensor 44 for detecting the temperature of ink; the heater 45; and the like. Note that the control unit 61 may employ a central processing unit (CPU) or a microprocessor unit (MPU) in place of the FPGA.

The control unit 61 is configured to output setting signals to the D/A converter 71 for setting output voltages of the power supply circuits 72-75. The setting signals are digital signals. The D/A converter 71 is configured to convert the digital setting signals outputted by the control unit 61 into analog setting signals and output the analog setting signals to the power supply circuits 72-75.

The power supply circuits 72-75 may be DC/DC converters configured of a plurality of electrical parts, such as FETs, inductors, resistors, and electrolytic capacitors, for example. Each of the power supply circuits 72-75 outputs an output voltage specified by the setting signals to the driver IC 43. The power supply circuits 72-75 are directly connected to the driver IC 43 by mutually different wires (not shown).

The driver IC 43 is connected to the control unit 61 via a plurality (N+1) of control lines (not shown). The driver IC 43 is also connected to each of actuators (not shown) for the N pieces of nozzles 41 and N pieces of nozzles 42 via N signal lines S(1)-S(N). Each signal line S is connected to an individual electrode of the actuator.

The control unit 61 is configured to send control signals to the driver IC 43 for controlling the driver IC 43 via the control lines. In response to these control signals, the driver IC 43 generates drive signals for driving the actuators, and outputs these generated drive signals to the corresponding actuators via the corresponding signal lines S. The drive signals are waveforms representing voltages to be applied to the actuators in a time series.

The control unit 61 is configured to control an ejection quantity of liquid through the nozzles 41 and 42. When the inkjet head 4 ejects droplets of ink based on prescribed image data, the control unit 61 selects a prescribed combination of the N pieces of nozzles based on the ejection quantity of ink droplets to be ejected from the nozzles 41 and 42. More specifically, temperature gradients of ink in the common liquid chambers 48*a* and 48*b* fluctuate according to the quantity of ink ejected from the nozzles 41 and 42. Since such a temperature gradient, i.e., unevenness of temperature, produces uneven viscosity in the ink, the size of the ejected ink droplets is also uneven. This leads to uneven density in a printed matter. To prevent this uneven density, the control unit 61 selects a prescribed combination of N nozzles having low temperature variation in accordance with the ejection quantity of droplets.

Temperature variation owing to the ejection quantities described above can be broadly divided among three types: temperature variation produced when the ejection quantity is small (hereinafter called a first temperature variation); temperature variation produced when the ejection quantity is large (hereinafter called a second temperature variation); and temperature variation produced when the ejection quantity is very large (hereinafter called a third temperature variation). These temperature irregularities will be described next in greater detail with reference to FIGS. 5-7.

Figure 5:
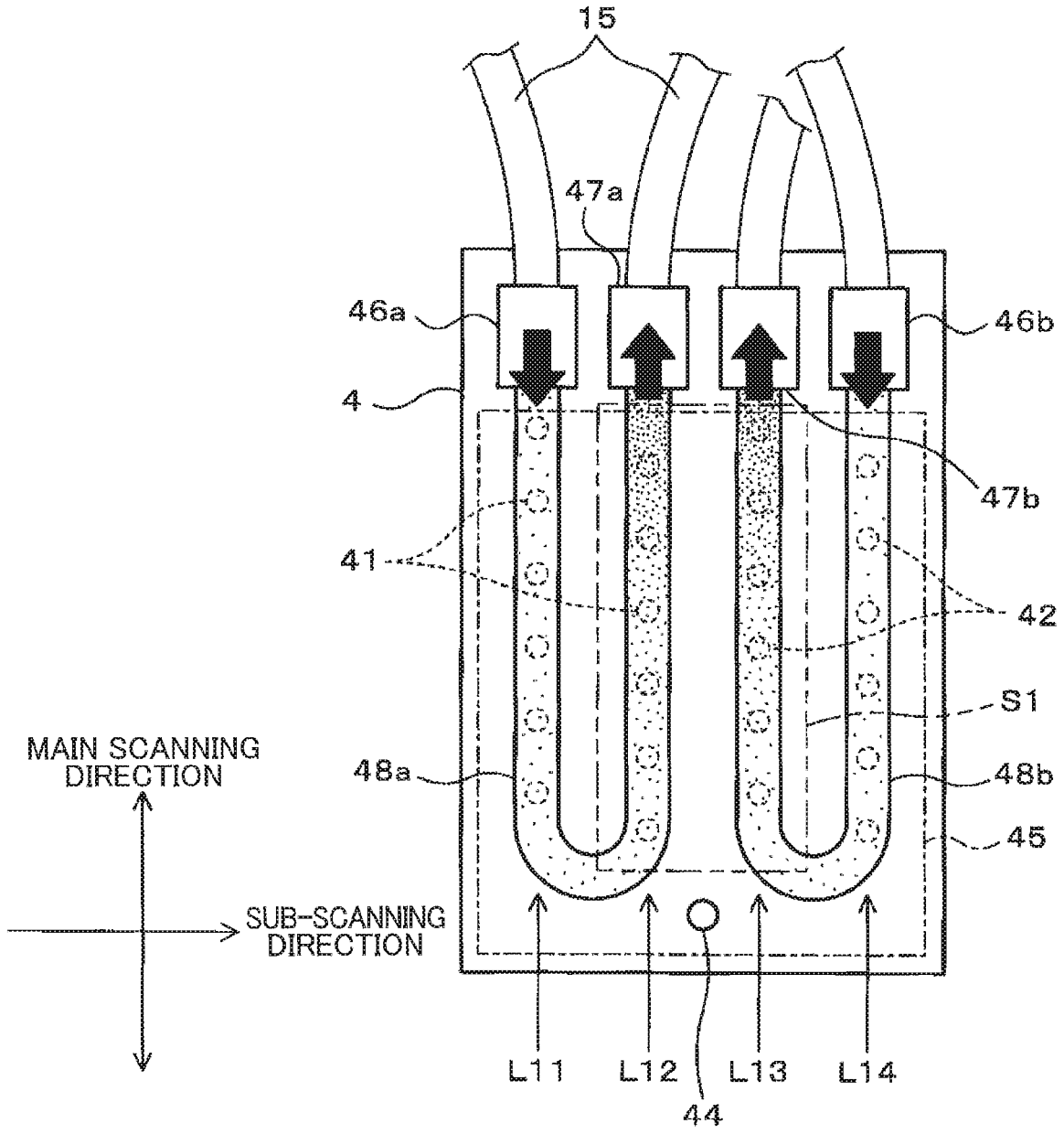
FIG. 5 is a schematic diagram schematically illustrating a first temperature variation that occurs in the inkjet head according to the first embodiment.
Figure 6:
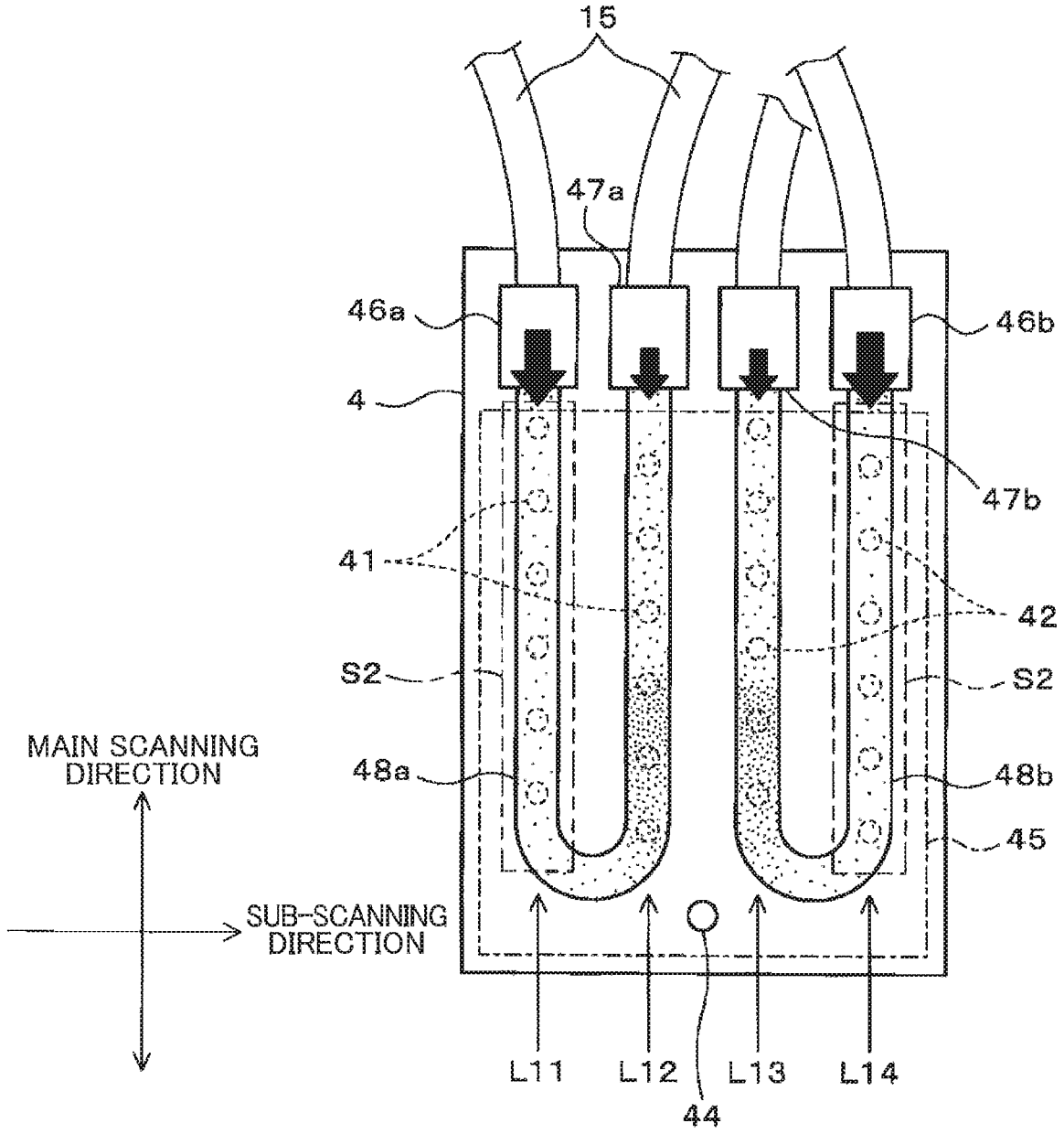
FIG. 6 is a schematic diagram schematically illustrating a second temperature variation that occurs in the inkjet head according to the first embodiment.

In FIGS. 5 and 6, temperature variation in ink is represented by the number of dots. Specifically, a large number of dots indicates a high ink temperature. The nozzle group L11, nozzle group L12, nozzle group L13, and nozzle group L14 shown in FIGS. 5-7 have already been described with reference to FIG. 3, and will not be descried again here.

As shown in FIG. 3, ink is supplied from the fill tank to the inkjet head 4 through the tubes 15. While ink passes through the tubes 15, heat in the ink is lost to the surroundings, causing the temperature of the ink to drop. The first temperature variation is caused by this drop in temperature. The first temperature variation occurs when a ratio of the ejection quantity to a maximum ejection quantity from the nozzles 41 and 42 is less than 50%, for example. FIG. 5 is a schematic diagram schematically illustrating the first temperature variation occurring in the inkjet head 4 according to the first embodiment. The black arrows in FIG. 5 indicate the flow of ink, and the size of the black arrows denotes the flow rate of ink.

Since a temperature drop occurs in ink passing through the tubes 15, as described above, ink of a low temperature flows into the first supply opening 46*a* and second supply opening 46*b*. Ink that flows into the first common liquid chamber 48*a* and second common liquid chamber 48*b* via the corresponding first supply opening 46*a* and second supply opening 46*b* is temporarily heated to a prescribed temperature by the heater 45. However, the heater 45 is provided so as to cover the first common liquid chamber 48*a* and second common liquid chamber 48*b*, as described above. Accordingly, ink is exposed to heat from the heater 45 while flowing from the first supply opening 46*a* and second supply opening 46*b* to the corresponding first discharge opening 47*a* and second discharge opening 47*b*. Thus, the ink temperature rises as the time period of exposure to the heat from the heater 45 increases. In other words, the ink positioned near the first discharge opening 47*a* and second discharge opening 47*b* that has been exposed to heat for the longest period of time has a higher temperature, and hence a lower ink viscosity, than the ink near the first supply opening 46*a* and second supply opening 46*b* that has been exposed to heat for the shortest period of time.

The second temperature variation occurs when the ratio of the ejection quantity to the maximum ejection quantity from the nozzles 41 and 42 is greater than or equal to 50%, for example. In such cases, negative pressure in the first common liquid chamber 48*a* and second common liquid chamber 48*b* increases along with an increase in ejection quantity. As a result, ink does not flow from the first discharge opening 47*a* and second discharge opening 47*b* to the drain tank, but rather ink in the drain tank is drawn into the first common liquid chamber 48*a* and second common liquid chamber 48*b*. In other words, ink in the drain tank flows backward through the first discharge opening 47*a* and second discharge opening 47*b* into the first common liquid chamber 48*a* and second common liquid chamber 48*b*, respectively. FIG. 6 is a schematic diagram schematically illustrating the second temperature variation that occurs in the inkjet head 4 according to the first embodiment. Black arrows in FIG. 6 indicate the flow of ink, and the size of the arrows represents the flow rate of ink.

As with the first temperature variation described above, this reverse flow also causes the ink temperature to drop when the ink passes through the tubes 15. Hence, ink having a low temperature flows into the first supply opening 46*a* and second supply opening 46*b*. While the ink is subsequently heated by the heater 45, the temperature of the ink continues to rise as the ink moves farther away from the first supply opening 46*a* and second supply opening 46*b*, as in the first temperature variation described above. In other words, the ink temperature increases as the length of exposure to heat increases. However, there is both an inflow (circulation) of ink from the first supply opening 46*a* and second supply opening 46*b* and a reverse flow of ink from the first discharge opening 47*a* and second discharge opening 47*b*. As a result, the ink being circulated collides with the ink flowing in reverse within the first common liquid chamber 48*a* and second common liquid chamber 48*b*, producing a large temperature variation and thus a large irregularity in ink viscosity, as illustrated in FIG. 6.

Figure 7:
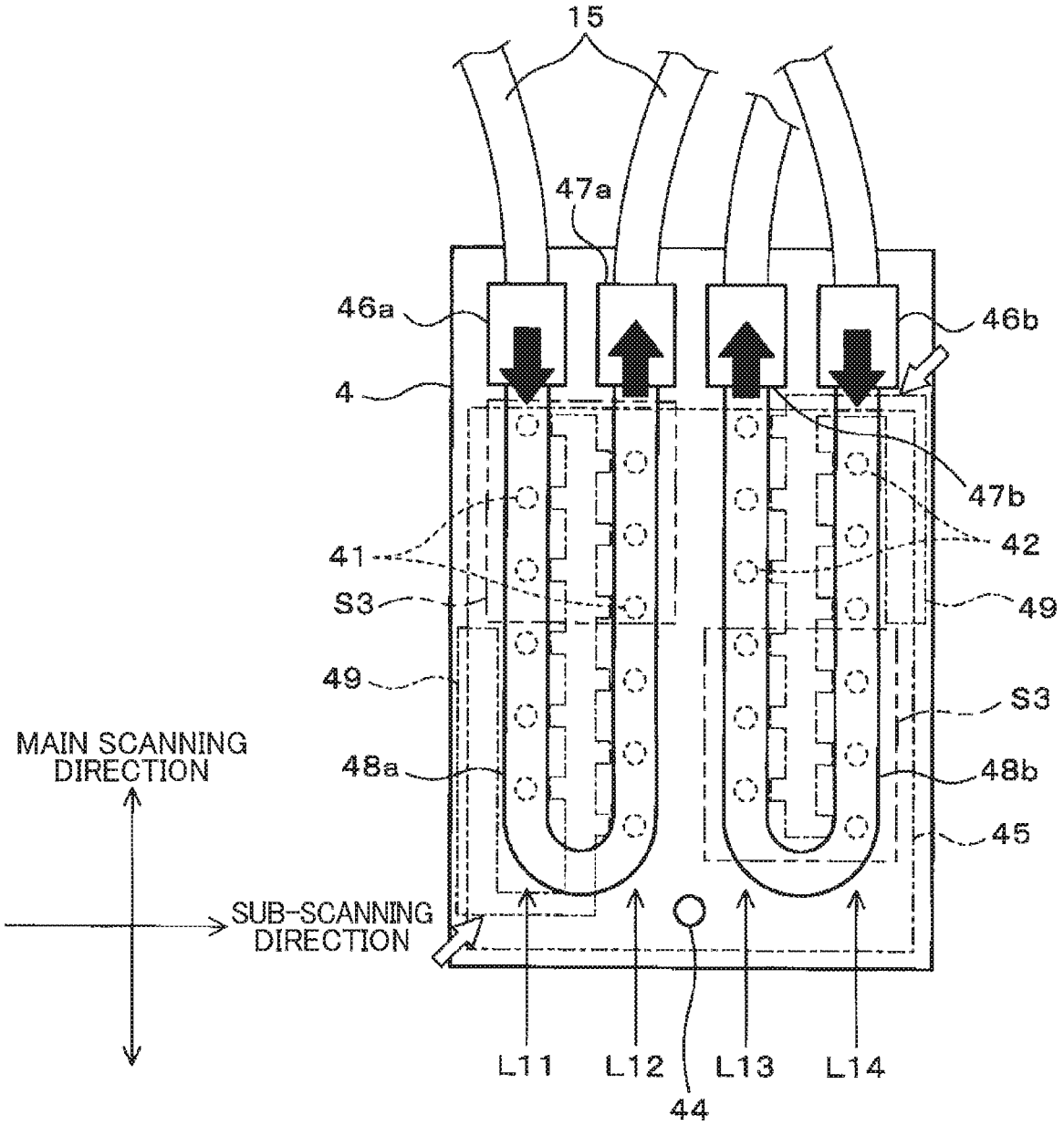
FIG. 7 is a schematic diagram schematically illustrating a third temperature variation that occurs in the inkjet head according to the first embodiment.

The third temperature variation occurs when the ratio of the ejection quantity to the maximum ejection quantity from the nozzles 41 and 42 is greater than or equal to 80%, for example. When the ejection quantity is very large, as in this case, heat is generated locally in the inkjet head 4. The third temperature variation is caused by this locally generated heat. FIG. 7 is a schematic diagram schematically illustrating the third temperature variation occurring in the inkjet head 4 according to the first embodiment.

In the inkjet head 4, one actuator having a drive element is provided for each of the nozzles 41 and 42 in order to eject ink droplets from the same. The actuator has a piezoelectric element, for example. The power board 7 applies voltages to the piezoelectric elements as the waveforms described above. The voltages cause the piezoelectric elements to vibrate and eject ink droplets from the corresponding nozzles 41 and 42.

In order to drive the actuators, branch-like electrodes 49 are provided to supply electric current to the drive elements of the individual actuators provided for the respective nozzles. However, owing to convenience of design, the electrodes 49 have locally narrow portions (indicated by white arrows in FIG. 7). The electrical resistance is higher in these narrow portions. When the ejection quantity is very large, particularly when the ratio of the ejection quantity to the maximum ejection quantity is 80% or greater, a large amount of heat is generated in the narrow portions of the electrodes 49. In other words, the narrow portions become sources of heat when the ejection quantity is very large. The increase in ink temperature around these narrow portions of the electrodes 49 produces temperature variation in the ink, and thus a large variation in ink viscosity.

Figure 8:
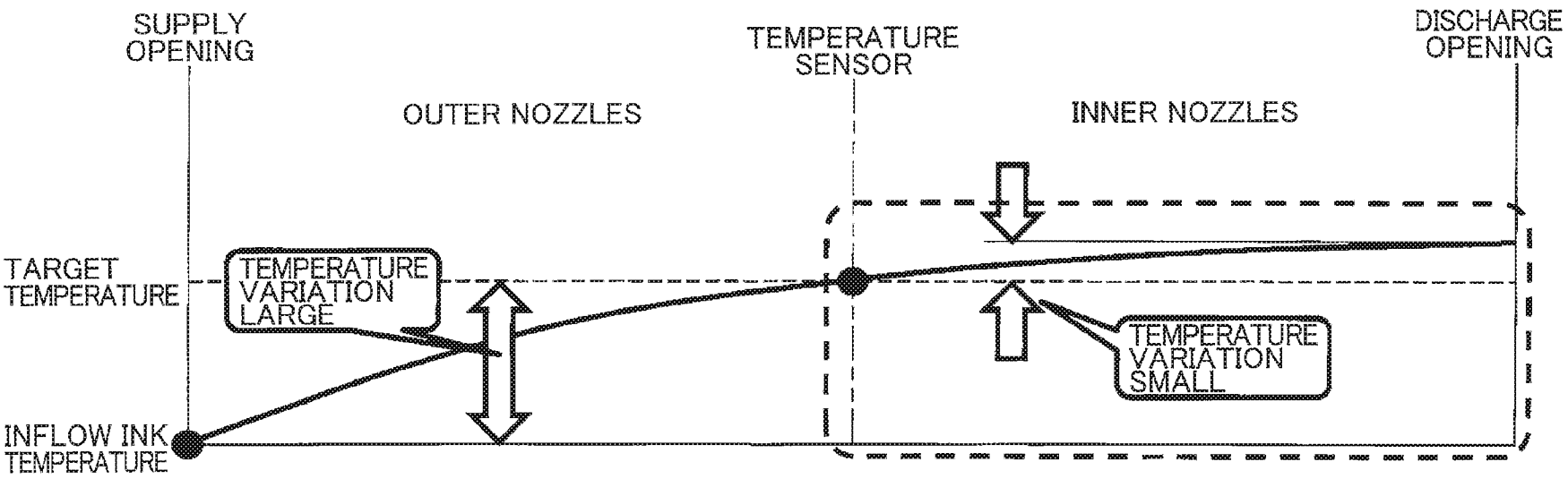
FIG. 8 is a graph representing the first temperature variation when ink circulates in the inkjet head according to the first embodiment.
Figure 9:
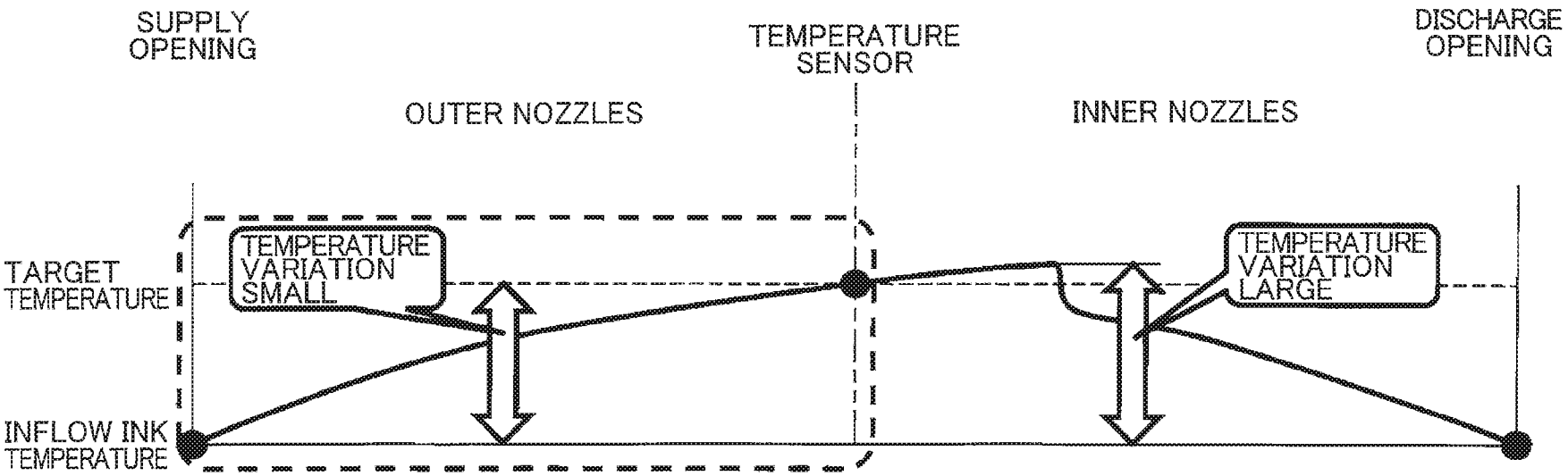
FIG. 9 is a graph representing the second temperature variation when ink flows in reverse in the inkjet head according to the first embodiment.

To handle these types of temperature variations, the control unit 61 selects a prescribed combination of N pieces of nozzles whose ink temperature has little variation based on the ejection quantity from the nozzles 41 and 42. FIG. 8 is a graph representing the first temperature variation when ink circulates in the inkjet head 4 according to the first embodiment, and FIG. 9 is a graph representing the second temperature variation when ink flows in reverse in the inkjet head 4 according to the first embodiment. In both FIGS. 8 and 9, the vertical axis represents temperature and the horizontal axis indicates the position in the first common liquid chamber 48*a* and second common liquid chamber 48*b*.

As shown in FIG. 8, the temperature of ink rises as the ink circulating from the first supply opening 46*a* and second supply opening 46*b* approaches the corresponding first discharge opening 47*a* and second discharge opening 47*b*. However, from a reference point of the intermediate area in which the temperature sensor 44 is disposed, temperature variation near to the first discharge opening 47*a* and second discharge opening 47*b* is clearly smaller than temperature variation near the first supply opening 46*a* and second supply opening 46*b*. In FIG. 5, corresponding inner nozzles (the nozzle group L12 and nozzle group L13) near the first discharge opening 47*a* and second discharge opening 47*b* having a small temperature variation are enclosed in a dashed rectangle.

On the other hand, when ink flows in reverse, as shown in FIG. 9, the reverse-flowing ink collides with circulating ink at a position closer to the first discharge opening 47*a* and second discharge opening 47*b* from the reference point of the intermediate area in which the temperature sensor 44 is disposed. The temperature of the ink changes sharply near the position where this ink collision occurs. As a result, temperature variation near the first supply opening 46*a* and second supply opening 46*b* is clearly smaller than temperature variation near the first discharge opening 47*a* and second discharge opening 47*b*. In FIG. 6, corresponding outer nozzles (the nozzle group L11 and nozzle group L14) near the corresponding first supply opening 46*a* and second supply opening 46*b* at which temperature variation is small are enclosed by dashed rectangles.

Finally, when the ejection quantity is very large so that narrow portions (heat sources) of the electrodes 49 generate heat, temperature variation is smaller in areas separated by a prescribed distance from the narrow portions of the electrodes 49. In FIG. 7, corresponding nozzles (hereinafter, called isolated nozzles) in areas separated from the narrow portions of the electrodes 49 are enclosed by dashed rectangles.

Based on the above configuration, the control unit 61 selects a prescribed combination of N pieces of nozzles having little ink temperature variation. Specifically, the control unit 61 determines whether the ejection quantity is greater than or equal to a first threshold described later or less than the first threshold and selects a prescribed combination of nozzles based on the results of this determination. The first threshold is equivalent to an ejection quantity of 50% the maximum ejection quantity from the nozzles 41 and 42, for example.

When the control unit 61 determines that the ejection quantity of ink is less than the first threshold, the control unit 61 selects a combination of nozzles that includes L ($0<L<N$) inner nozzles in the first common liquid chamber 48*a* and (N−L) inner nozzles in the second common liquid chamber 48*b* (hereinafter called an inner combination S1) as nozzles to perform ejection (see FIG. 5). Specifically, the control unit 61 treats ink as circulating when determining that the ejection quantity of ink is less than the first threshold. Thus, the control unit 61 selects N pieces of nozzles from among the inner nozzles arranged near the first discharge opening 47*a* and second discharge opening 47*b* (the nozzle groups L12 and L13) as the nozzles to perform ejection.

This method can minimize the effects of temperature variation in ink produced when ink is circulating and can suppress the occurrence of irregular viscosity in ink caused by the ink temperature variation, i.e., the occurrence of density variation in a printed matter.

Further, when determining that the ejection quantity of ink is greater than or equal to the first threshold, the control unit 61 selects a combination of nozzles including M ($0<M<N$) pieces of outer nozzles in the first common liquid chamber 48*a* and (N−M) pieces of outer nozzles in the second common liquid chamber 48*b* (hereinafter called an outer combination S2) as nozzles to perform ejection (see FIG. 6). Specifically, the control unit 61 treats ink as flowing in reverse when determining that the ejection quantity of ink is greater than or equal to the first threshold. Thus, the control unit 61 selects N pieces of nozzles from among the outer nozzles arranged near the first supply opening 46*a* and second supply opening 46*b* (the nozzle groups L11 and L14) as the nozzles to perform ejection.

Here, M and L need not always be the same number, provided that the sum of M and L is equivalent to N. For convenience, the following description will be made assuming that M and L are the same number, i.e., both M and L are equivalent to N/2.

This method can minimize the effects of temperature variation in ink produced when ink flows in reverse and can suppress irregular ink viscosity caused by the ink temperature variation, i.e., the occurrence of density variation in the printed matter.

Further, in a case where the control unit 61 determines that the ejection quantity of ink is greater than or equal to the first threshold, the control unit 61 subsequently determines whether this ejection quantity is greater than or equal to a second threshold. The second threshold is higher than the first threshold. For example, the second threshold is equivalent to an ejection quantity of 80% the maximum ejection quantity from the nozzles 41 and 42. If the control unit 61 determines that the ejection quantity of ink is greater than or equal to the second threshold, the control unit 61 infers that heat is generated at the heat sources. Thus, the control unit 61 selects N pieces of nozzles configured of the isolated nozzles as the nozzles for performing ejection. That is, when the control unit 61 determines that the ejection quantity of ink is greater than or equal to the second threshold, the control unit 61 selects a combination of nozzles including the isolated nozzles in the first common liquid chamber 48*a* and the isolated nozzles in the second common liquid chamber 48*b* (hereinafter called an isolated combination S3) as the nozzles for performing ejection (see FIG. 7).

This method can minimize the effects of the generated heat on temperature variation in ink when heat is locally produced in the inkjet head 4 and can suppress irregular viscosity in the ink caused by the ink temperature variation, i.e., the occurrence of density variation in the printed matter.

Note that the nozzles selected from the first common liquid chamber 48*a* do not overlap the nozzles selected from the second common liquid chamber 48*b* in either the main scanning direction or the sub-scanning direction for any of the inner combination S1 (second combination), outer combination S2 (first combination), and isolated combination S3 described above.

In order to select a combination of nozzles, the control unit 61 calculates the ejection quantity from the nozzles 41 and 42 in advance based on image data received from the control device 8 and performs the determinations described above using the first threshold and second threshold for the calculated ejection quantity. When image data is received, the control unit 61 calculates an ejection quantity for each nozzle based on the image data prior to forming images on the recording medium based on this image data. The control unit 61 performs these calculations based on the voltages (waveforms) set for each nozzle to be used in the image formation.

Figures 10, 11:
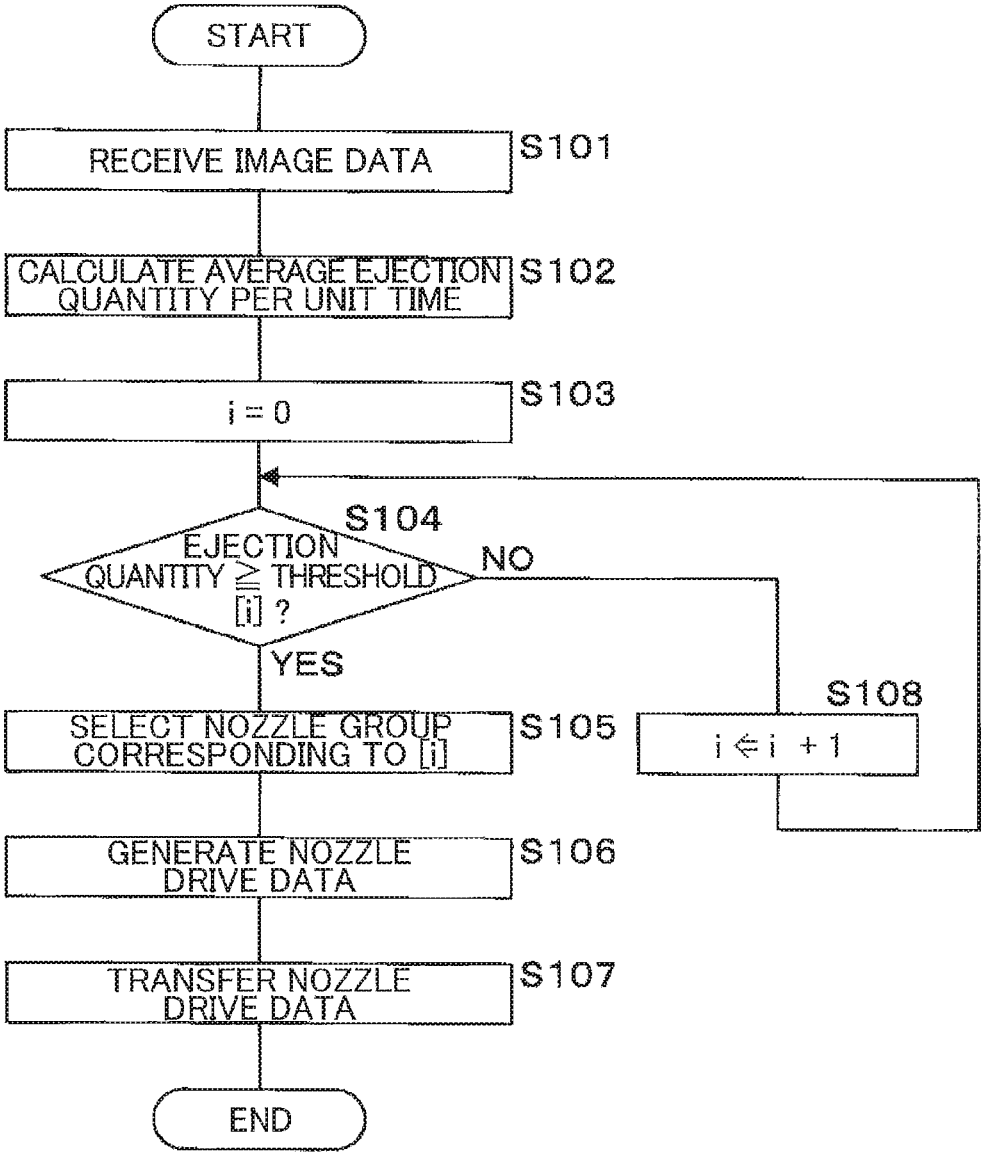
FIG. 10 is a conceptual drawing conceptually illustrating a threshold table stored in a nonvolatile memory of the inkjet head according to the first embodiment.
FIG. 11 is a flowchart describing how ink is ejected in the inkjet head according to the first embodiment.

The nonvolatile memory 63 stores a threshold table that correlates the nozzle combinations with the threshold values that the control unit 61 uses for performing the above determinations. FIG. 10 is a conceptual drawing conceptually illustrating a threshold table stored in the nonvolatile memory 63 of the inkjet head 4 according to the first embodiment.

The threshold table in the example shown in FIG. 10 is an example where the maximum ejection quantity of the nozzles 41 and 42 is 30 mL/min. In this threshold table, 16 mL/min is written as the first threshold for ejection quantity. The outer combination S2 described above is correlated with cases in which the calculated ejection quantity is greater than or equal to 16 mL/min, and the inner combination S1 described above is correlated with cases in which the calculated ejection quantity is less than 16 mL/min. 24 mL/min is also written in the threshold table as the second threshold. The isolated combination S3 described above is correlated with cases in which the calculated ejection quantity is greater than or equal to 24 mL/min.

Additionally, a variable i in the threshold table is "1" in association with the ejection quantities calculated to be greater than or equal to 16 mL/min, and is "2" in association with the ejection quantities calculated to be less than 16 mL/min. The variable i is "0" in the threshold table in association with the ejection quantities calculated to be greater than or equal to 24 mL/min.

FIG. 11 is a flowchart describing the ejection of ink by the inkjet head 4 according to the first embodiment. For convenience, the following description will use the threshold table in FIG. 10.

In step S101, the control unit 61 receives image data for forming images on a recording medium from the control device 8, for example.

When image data is received (step S101), in step S102 the control unit 61 calculates an average ejection quantity per unit time (minute). That is, the control unit 61 calculates the average ejection quantity per unit time from the voltages (waveform) set in the image data for each nozzle. A description has already been given for calculating the ejection quantity based on image data and will not be repeated here.

In step S103 the control unit 61 assigns "0" to the variable i and in step S104 determines whether the average ejection quantity calculated in step S102 is greater than or equal to the threshold correlated with the variable i. Hence, since the variable i is currently "0", the control unit 61 determines whether the average ejection quantity calculated in step S102 is greater than or equal to the threshold "24", which is correlated with the variable i of "0".

If the control unit 61 determines that the average ejection quantity calculated in step S102 is less than the threshold associated with the variable i (step S104: NO), in step S108 the control unit 61 increments the current variable i by "1" to set a new variable i (i+1), and subsequently returns to the step S104.

When the control unit 61 determines that the average ejection quantity calculated in step S102 is greater than or equal to the threshold associated with the variable i (step S104: YES), in step S105 the control unit 61 selects the nozzle groups associated with the current value of i as the nozzles to be used in the image formation.

For example, if i is currently "0", the control unit 61 selects the isolated combination S3 based on the threshold table. Specifically, the control unit 61 selects the (N/2 pieces of) isolated nozzles in the first common liquid chamber 48*a* and (N/2 pieces of) isolated nozzles in the second common liquid chamber 48*b*. If i is currently "1", the control unit 61 selects the outer combination S2. Specifically, the control unit 61 selects the (N/2 pieces of) outer nozzles arranged near the first supply opening 46*a* and (N/2 pieces of) outer nozzles arranged near the second supply opening 46*b*. Further, if i is currently "2", the control unit 61 selects the inner combination S1. Specifically, the control unit 61 selects the (N/2 pieces of) inner nozzles arranged near the first discharge opening 47*a* and (N/2 pieces of) inner nozzles arranged near the second discharge opening 47*b*.

Next, in step S106 the control unit 61 generates nozzle drive data based on the selection results in step S105. The nozzle drive data includes data designating the size of droplets to be ejected from each nozzle in the nozzle combination selected in step S105. Additionally, the control unit 61 generates the setting signals described above defining the voltages (waveforms) to be applied to the actuators for each nozzle based on this nozzle drive data.

In step S107 the control unit 61 transfers the nozzle drive data generated in S106 to the driver IC 43 of each inkjet head 4 and transfers the settings signals to the power board 7. Thereafter, each of the power supply circuits 72-75 outputs a voltage specified by the setting signals to the driver IC 43. The driver IC 43 selects signal lines (nozzles) from among the N signal lines S(1)-S(N) based on the received nozzle drive data, and applies the voltages from the power board 7 to the actuators of the selected nozzles 41 and 42 through the selected signal lines.

In this way, in the inkjet head 4 according to the present embodiment, when temperature variation, i.e., viscosity variation occurs in ink in the inkjet head 4 (the first common liquid chamber 48*a* and the second common liquid chamber 48*b*) in response to the ejection quantity of ink from the nozzles 41 and 42, ink is configured to be ejected through those nozzles in areas where variation in ink temperature is small. This method can suppress the occurrence of density variation in the printed matter caused by the temperature variation in ink produced according to the ink ejection quantity.

Variations

In the above description, when the ink ejection quantity is determined to be greater than or equal to the first threshold, the control unit 61 instantly changes the nozzles to be used for ejection from the nozzles in the inner combination S1 to the nozzles in the outer combination S2 and performs image formation using these nozzles in the outer combination S2. However, the inkjet head 4 according to the present embodiment is not limited to this configuration.

Immediately after the ink ejection quantity is determined to be greater than or equal to the first threshold, i.e., immediately after the state of ink flow switches from a circulating state to a reverse flow state, a prescribed quantity of warm ink discharged in the circulating state remains near the first discharge opening 47*a* and second discharge opening 47*b*.

Hence, when the ink ejection quantity is determined to be greater than or equal to the first threshold, i.e., when the state of ink flow switches from the circulating state to the reverse flow state, the nozzles used for ejection may be switched from the nozzles in the inner combination S1 to the nozzles in the outer combination S2 after a prescribed time has elapsed, and image formation using the nozzles in the outer combination S2 may be started at this time.

Second Embodiment

In the description provided above, used is an example in which the first common liquid chamber 48*a* and second common liquid chamber 48*b* are both U-shaped. However, the present invention is not limited to this configuration.

Figure 12:
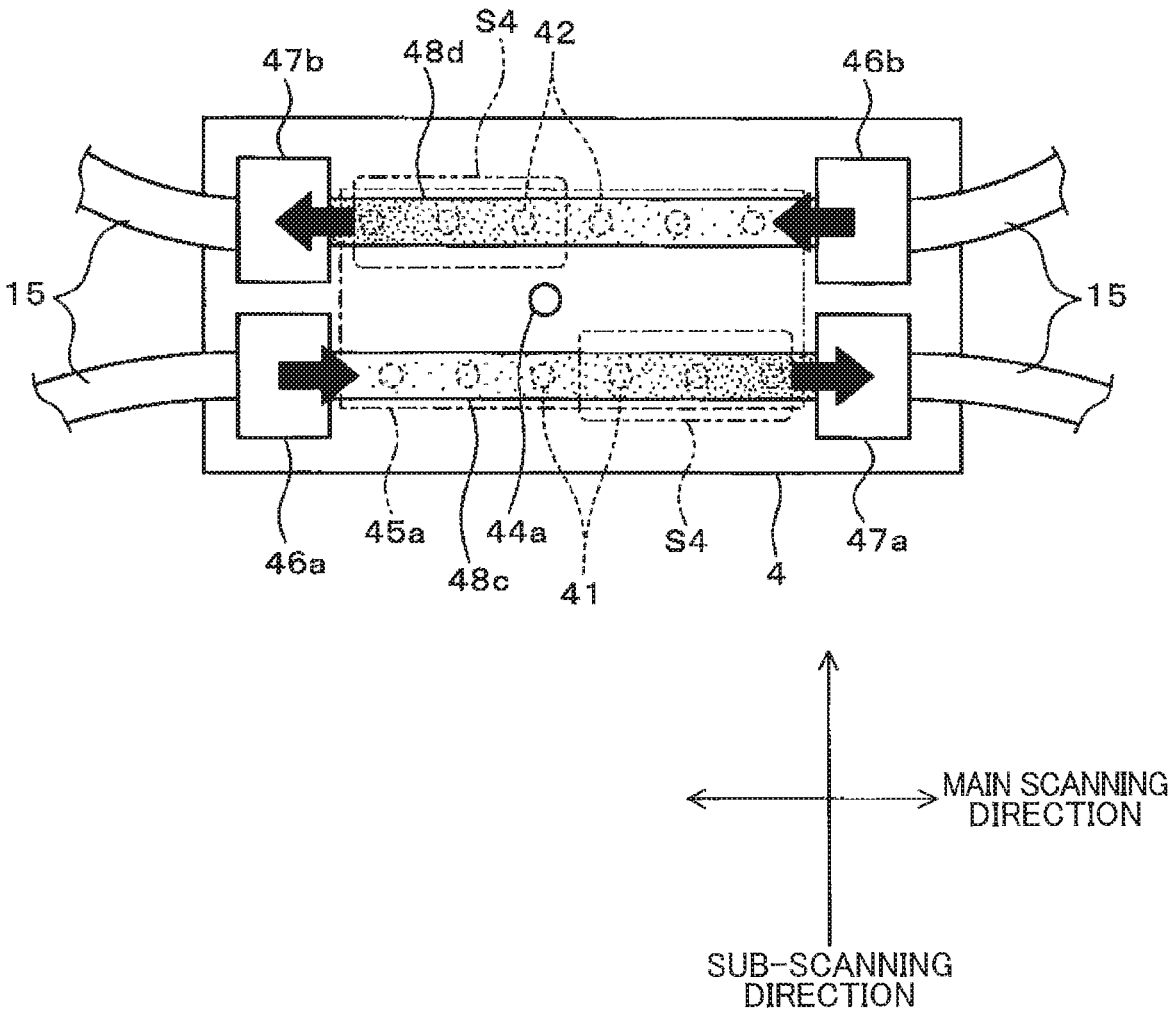
FIG. 12 is a schematic diagram schematically illustrating a first temperature variation that occurs in an inkjet head according to a second embodiment.
Figure 13:
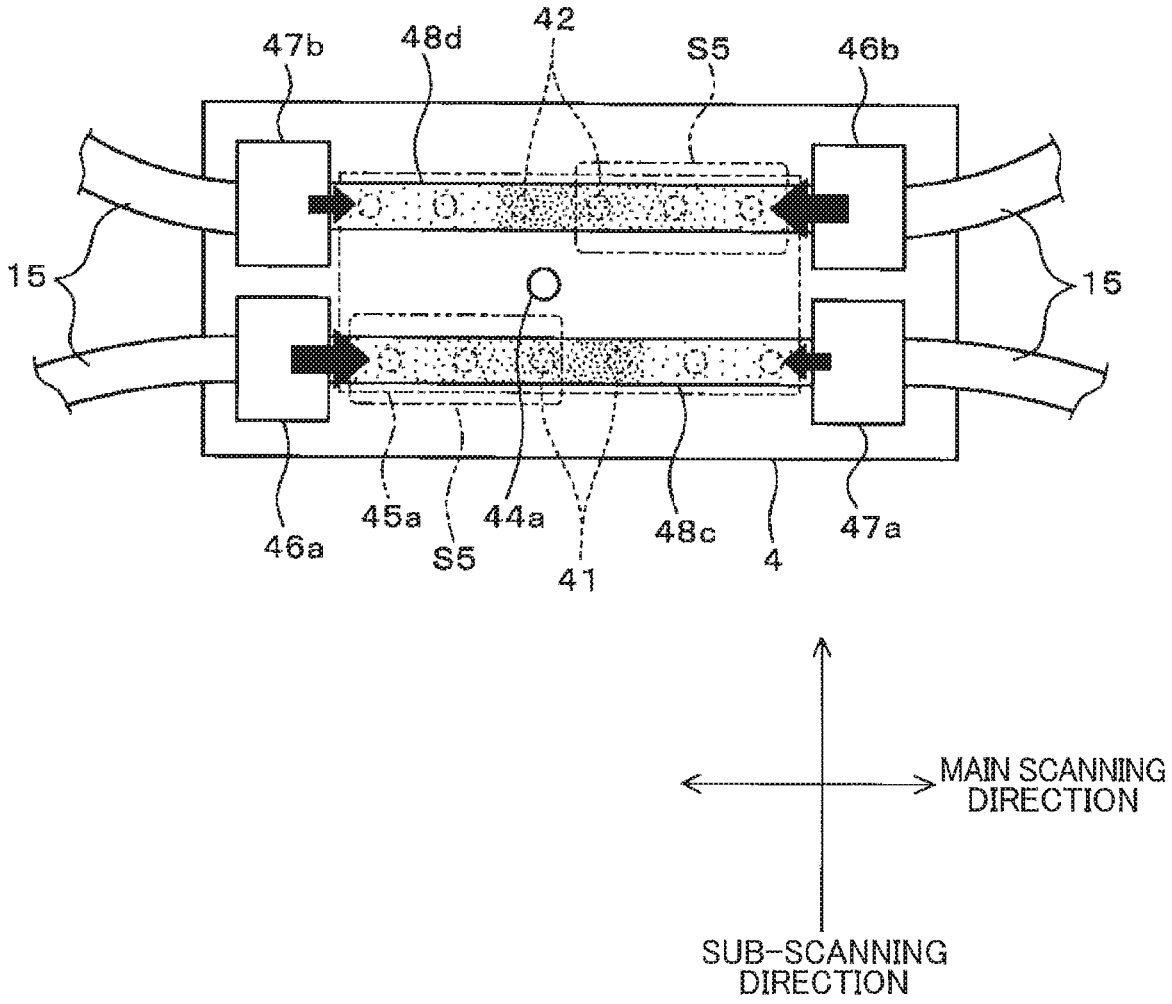
FIG. 13 is a schematic diagram schematically illustrating a second temperature variation that occurs in the inkjet head according to the second embodiment.

In a second embodiment, the inkjet head 4 has two common chambers: a first common liquid chamber 48*c* for the nozzles 41, and a second common liquid chamber 48*d* for the nozzles 42 (see FIGS. 12 and 13). The inkjet head 4 also has the first supply opening 46*a* and second supply opening 46*b* that receive ink supplied from the fill tank, and the first discharge opening 47*a* and second discharge opening 47*b* that discharge the ink to the drain tank.

The first supply opening 46*a* and second discharge opening 47*b* are juxtaposed in the sub-scanning direction on one end of the inkjet head 4 in the main scanning direction, and the second supply opening 46*b* and first discharge opening 47*a* are juxtaposed in the sub-scanning direction on the other end in the main scanning direction. In other words, the first supply opening 46*a* and second supply opening 46*b* are respectively provided on either side in the main scanning direction, while the first discharge opening 47*a* and second discharge opening 47*b* are respectively provided on either side in the main scanning direction. That is, the first supply opening 46*a* and the second discharge opening 47*b* are arranged in line in the sub-scanning direction, and the first discharge opening 47*a* and the second supply opening 46*b* are arranged in line in the sub-scanning direction.

The first common liquid chamber 48*c* has a linear shape and connects the first supply opening 46*a* to the first discharge opening 47*a*. The second common liquid chamber 48*d* has a linear shape and connects the second supply opening 46*b* to the second discharge opening 47*b*. The first common liquid chamber 48*c* is in communication with the N pieces of nozzles 41, for example, and the second common liquid chamber 48*d* is in communication with the pieces of N nozzles 42, for example.

With this configuration, in the inkjet head 4 according to the second embodiment, the direction in which ink flows through the first common liquid chamber 48*c* is opposite the direction in which ink flows through the second common liquid chamber 48*d*.

A rectangular sheet-like heater 45*a* is provided on the top surface and/or bottom surface of the inkjet head 4 so as to cover the first common liquid chamber 48*c* and second common liquid chamber 48*d*. The heater 45*a* applies heat to the ink flowing through the first common liquid chamber 48*c* and second common liquid chamber 48*d*. A temperature sensor 44*a* is provided between the first common liquid chamber 48*c* and second common liquid chamber 48*d* at an intermediate position along the lengths of the first common liquid chamber 48*c* and second common liquid chamber 48*d*.

Next, a first temperature variation and a second temperature variation occurring in the inkjet head 4 according to the second embodiment will be described in detail with reference to FIGS. 12 and 13. In FIGS. 12 and 13, the temperature variation in ink is represented by the number of dots. Specifically, a large number of dots indicates a high ink temperature.

The first temperature variation occurs when the ratio of the ejection quantity to the maximum ejection quantity from the nozzles 41 and 42 is less than 50%, for example. FIG. 12 is a schematic diagram schematically illustrating the first temperature variation occurring in the inkjet head 4 according to the second embodiment. The black arrows in FIG. 12 indicate the flow of ink, and the size of the black arrows denotes the flow rate of ink.

Ink flows from the fill tank into the first supply opening 46*a* and second supply opening 46*b* and is discharged to the drain tank through the first discharge opening 47*a* and second discharge opening 47*b* (circulation). However, as mentioned above, the temperature of ink supplied from the fill tank to the inkjet head 4 through the tubes 15 drops while passing through the tubes 15. Hence, the ink flowing into the first supply opening 46*a* and second supply opening 46*b* has a low temperature. At this time, the ink that flows into the first common liquid chamber 48*c* and second common liquid chamber 48*d* through the first supply opening 46*a* and second supply opening 46*b* is heated to a prescribed temperature by the heater 45*a*. However, ink positioned near the first discharge opening 47*a* and second discharge opening 47*b* that has been exposed to heat from the heater 45*a* for the longest period of time has a higher temperature, and hence a lower viscosity, than ink near the first supply opening 46*a* and second supply opening 46*b* that has been exposed to heat for the shortest period of time.

As in the first embodiment, when this type of first temperature variation occurs, temperature variation near the first discharge opening 47*a* and second discharge opening 47*b* is smaller than temperature variation near the first supply opening 46*a* and second supply opening 46*b* from the intermediate area in which the temperature sensor 44*a* is disposed. In FIG. 12, corresponding nozzles near the first discharge opening 47*a* and second discharge opening 47*b* having a small temperature variation are enclosed by rectangles formed of two-dot chain lines.

When ejecting ink based on received image data, the control unit 61 determines whether the ejection quantity is not less than the first threshold or less than the first threshold. The first threshold is equivalent to an ejection quantity that is 50% of the maximum ejection quantity from the nozzles 41 and 42, for example.

If the control unit 61 determines that the ejection quantity of ink is less than the first threshold, the control unit 61 treats the ink as circulating and selects the N pieces of nozzles configured of the nozzles arranged near the first discharge opening 47*a* and second discharge opening 47*b* (the rectangles defined by two-dot chain lines in FIG. 12) as nozzles to perform ejection. Hence, when the ink ejection quantity is determined to be less than the first threshold, the control unit 61 selects a nozzle combination S4 configured of: the (N/2 pieces of) nozzles near the first discharge opening 47*a*; and (N/2 pieces of) nozzles near the second discharge opening 47*b* as the nozzles to perform ejection.

This method can minimize the effects of temperature variation in ink produced when ink is circulating and can suppress the occurrence of viscosity irregularity in ink caused by the ink temperature variation, i.e., the occurrence of density variation in a printed matter, when the first common liquid chamber 48*c* and second common liquid chamber 48*d* are formed linearly.

The second temperature variation occurs when the ratio of the ejection quantity to the maximum ejection quantity from the nozzles 41 and 42 is greater than or equal to 50%, for example. As described above, the second temperature variation is caused by negative pressure in the first common liquid chamber 48*c* and second common liquid chamber 48*d* that increases along with an increase in the ejection quantity, causing ink to flow in reverse from the drain tank into the first common liquid chamber 48*c* and second common liquid chamber 48*d* through the first discharge opening 47*a* and second discharge opening 47*b*. FIG. 13 is a schematic diagram schematically illustrating the second temperature variation that occurs in the inkjet head 4 according to the second embodiment. Black arrows in FIG. 13 indicate the flow of ink, and the size of the arrows represents the flow rate of ink.

As with the first temperature variation described above, this reverse flow also produces a temperature drop when ink passes through the tubes 15. Hence, ink having a low temperature flows into the first discharge opening 47*a* and second discharge opening 47*b*. Although the ink is subsequently heated by the heater 45*a*, as in the case of the first temperature variation, the temperature of the ink continues to rise as the ink moves farther away from the first supply opening 46*a* and second supply opening 46*b*, i.e., as the length of exposure to heat increases. However, there is both an inflow (circulation) of ink from the first supply opening 46*a* and second supply opening 46*b*, and a reverse flow of ink from the first discharge opening 47*a* and second discharge opening 47*b*. As a result, ink that is circulating collides with ink that is flowing in reverse in an area closer to the first discharge opening 47*a* and second discharge opening 47*b* from the temperature sensor 44*a* as the reference point, producing a large temperature variation, and thus a large irregularity in ink viscosity, as illustrated in FIG. 13.

In this way, since ink that is circulating collides with ink that is flowing in reverse near the first discharge opening 47*a* and second discharge opening 47*b* when a backflow of ink occurs, the temperature variation near the first supply opening 46*a* and second supply opening 46*b* is less than the temperature variation near the first discharge opening 47*a* and second discharge opening 47*b*. In FIG. 13, the corresponding nozzles near the first supply opening 46*a* and second supply opening 46*b* at which temperature variation is small are enclosed by rectangles formed of two-dot chain lines.

When ejecting ink based on received image data, the control unit 61 determines whether the ejection quantity is greater than or equal to the first threshold or less than the first threshold. When determining that the ejection quantity of ink is greater than or equal to the first threshold, the control unit 61 treats the ink as flowing in reverse and selects N pieces of nozzles configured of the nozzles arranged near the first supply opening 46*a* and second supply opening 46*b* (in the rectangles depicted with two-dot chain lines in FIG. 13) as nozzles to perform ejection. That is, when determining that the ink ejection quantity is greater than or equal to the first threshold, the control unit 61 selects a nozzle combination S5 configured of: the (N/2 pieces of) nozzles near the first supply opening 46*a*; and (N/2 pieces of) nozzles near the second supply opening 46*b* as the nozzles to perform ejection.

When the first common liquid chamber 48*c* and second common liquid chamber 48*d* are linear shaped, this method can minimize the effects of temperature variation in ink produced when ink is flowing in reverse and can suppress the occurrence of viscosity irregularity in ink caused by the ink temperature variation, i.e., the occurrence of density variation in the printed matter.

The parts similar to those in the first embodiment are designated with the same reference numerals to avoid duplicating description.

REMARKS

In the present disclosure, the inkjet printer 1 is an example of a droplet ejecting device. The first nozzle group 41G is an example of a first nozzle group. The second nozzle group 42G is an example of a second nozzle group. The nozzles 41 are an example of first nozzles, and the second nozzle group 42G are an example of second nozzles. The control unit 61 is an example of a controller. The outer combination S2 is an example of a first combination. The inner combination S1 is an example of a second combination. The isolated combination S3 is an example of a third combination. The first common liquid chambers 48*a*, 48*c* are an example of a first common liquid chamber. The second common liquid chambers 48*b*, 48*d* are an example of a second common liquid chamber. The first supply opening 46*a* is an example of a first supply opening. The second supply opening 46*b* is an example of a second supply opening. The first discharge opening 47*a* is an example of a first discharge opening, and the second discharge opening 47*b* is an example of a second discharge opening. The nozzle group L11 is an example of a first nozzle array. The nozzle group is an example of a second nozzle array. The nozzle group L13 is an example of a third nozzle array. The nozzle group L14 is an example of a fourth nozzle array. The temperature sensors 44, 44*a* are an example of a temperature sensor. The heaters 45 and 45*a* are an example of a heater.

What is claimed is:

1. A droplet ejecting device comprising:

a first nozzle group consisting of N pieces of first nozzles aligned in a first direction;

a second nozzle group consisting of N pieces of second nozzles aligned in the first direction, the second nozzles in the second nozzle group being respectively at the same positions in the first direction as the first nozzles in the first nozzle group; and a controller configured to control an ejection quantity of liquid through the first nozzles and the second nozzles and determine whether the ejection quantity of the liquid per unit time is equal to or greater than a first threshold, the controller being configured to:

select a first combination of N pieces in total of nozzles from among the N pieces of first nozzles and among the N pieces of second nozzles to be used for image formation in a case where the ejection quantity is equal to or greater than the first threshold; and select a second combination of N pieces in total of nozzles from among the N pieces of first nozzles and among the N pieces of second nozzles to be used for image formation in a case where the ejection quantity is smaller than the first threshold.

2. The droplet ejecting device according to claim 1, further comprising:

a first supply opening;

a first common liquid chamber having one end connected to the first supply opening and in communication with the N pieces of first nozzles in the first nozzle group, the first common liquid chamber defining a first center in an entire length thereof;

a first discharge opening connected to another end of the first common liquid chamber to allow the liquid introduced through the first supply opening into the first common liquid chamber to be discharged therefrom through the first discharge opening;

a second supply opening;

a second common liquid chamber having one end connected to the second supply opening and in communication with the N pieces of second nozzles in the second nozzle group, the second common liquid chamber defining a second center in an entire length thereof; and a second discharge opening connected to another end of the second common liquid chamber to allow the liquid introduced through the second supply opening into the second common liquid chamber to be discharged therefrom through the second discharge opening, wherein:

the first combination consists of: M pieces of the first nozzles near the first supply opening from the first center among the N pieces of first nozzles, where M is $0<M<N$; and [N−M] pieces of the second nozzles near the second supply opening from the second center among the N pieces of second nozzles, and the second combination consists of: L pieces of the first nozzles near the first discharge opening from the first center among the N pieces of first nozzles, where L is $0<L<N$; and [N−L] pieces of the second nozzles near the second discharge opening from the second center among the N pieces of second nozzles.

3. The droplet ejecting device according to claim 2, wherein M and L are equal to each other.

4. The droplet ejecting device according to claim 2, further comprising a heater for applying heat to the liquid in the first common liquid chamber and in the second common liquid chamber.

5. The droplet ejecting device according to claim 2, wherein the first common liquid chamber and the second common liquid chamber are respectively U-shaped, and wherein the first supply opening, the first discharge opening, the second supply opening and the second discharge opening are aligned in a second direction perpendicular to the first direction.

6. The droplet ejecting device according to claim 5, wherein the N pieces of first nozzles in the first common liquid chamber comprise: a first nozzle array consisting of a plurality of the first nozzles juxtaposed with the first supply opening in the first direction; and a second nozzle array consisting of a plurality of the first nozzles juxtaposed with the first discharge opening in the first direction, wherein the N pieces of second nozzles in the second common liquid chamber comprise: a third nozzle array consisting of a plurality of the second nozzles juxtaposed with the second discharge opening in the first direction; and a fourth nozzle array consisting of a plurality of the second nozzles juxtaposed with the second supply opening in the first direction, wherein the plurality of the first nozzles in the first nozzle array is respectively at the same positions in the first direction as the plurality of the second nozzles in the third nozzle array, wherein the plurality of the first nozzles in the second nozzle array is respectively at the same positions in the first direction as the plurality of the second nozzles in the fourth nozzle array, wherein the plurality of the first nozzles in the first nozzle array is arranged respectively at different positions in the first direction from the plurality of the first nozzles in the second nozzle array, and wherein the plurality of the second nozzles in the third nozzle array is arranged respectively at different positions in the first direction from the plurality of the second nozzles in the fourth nozzle array.

7. The droplet ejecting device according to claim 2, further comprising:

a heater for applying heat to the liquid in the first common liquid chamber and in the second common liquid chamber; and a temperature sensor positioned opposite to the first supply opening and the first discharge opening with respect to the N pieces of first nozzles in the first direction, and opposite to the second supply opening and the second discharge opening with respect to the N pieces of second nozzles in the first direction.

8. The droplet ejecting device according to claim 2, wherein the first common liquid chamber and the second common liquid chamber respectively have a linear shape extending in the first direction, wherein the first supply opening and the first discharge opening are positioned opposite each other in the first direction in the first common liquid chamber, and the second discharge opening and the second supply opening are positioned opposite each other in the first direction in the second common liquid chamber, and wherein the first supply opening and the second discharge opening are aligned in a second direction perpendicular to the first direction, and the first discharge opening and the second supply opening are aligned in the second direction.

9. The droplet ejecting device according to claim 2, further comprising a heat source configured to generate heat in response to an increase in the ejection quantity per unit of time, wherein, in a case where the ejection quantity is equal to or greater than a second threshold greater than the first threshold, the controller is configured to select a third combination of N pieces in total of the first nozzles and the second nozzles that are positioned away from the heat source by a prescribed distance in the first direction from among the N pieces of first nozzles and among the N pieces of second nozzles.

10. The droplet ejecting device according to claim 1, wherein, when the ejection quantity is determined to be equal to or greater than the first threshold, the controller is configured to start performing the image formation with the first combination of the N pieces of nozzles after elapse of a prescribed period of time.

11. The droplet ejecting device according to claim 1, further comprising a heat source configured to generate heat in response to an increase in the ejection quantity per unit of time, wherein the first combination consists of the first nozzles and the second nozzles positioned away from the heat source by a prescribed distance in the first direction.

12. A droplet ejecting device comprising:

a first nozzle group consisting of N pieces of first nozzles aligned in a first direction; and a second nozzle group consisting of N pieces of second nozzles aligned in the first direction, the second nozzles in the second nozzle group being respectively at the same positions in the first direction as the first nozzles in the first nozzle group, the first nozzle group and the second nozzle group being configured to eject liquid therethrough, wherein:

in a case where an ejection quantity of the liquid per unit time is equal to or greater than a first threshold, a first combination of N pieces in total of nozzles are selected from among the N pieces of first nozzles and the N pieces of second nozzles to be used for image formation; and in a case where the ejection quantity is smaller than the first threshold, a second combination of N pieces in total of nozzles are selected from among the N pieces of first nozzles and the N pieces of second nozzles to be used for image formation.

13. A method of controlling an ejection quantity of liquid through a first nozzle group and a second nozzle group of a droplet ejecting device, the first nozzle group consisting of N pieces of first nozzles aligned in a first direction, the second nozzle group consisting of N pieces of second nozzles aligned in the first direction, the second nozzles in the second nozzle group being respectively at the same positions in the first direction as the first nozzles in the first nozzle group, the method comprising:

determining whether the ejection quantity of the liquid per unit time is equal to or greater than a first threshold;

selecting a first combination of N pieces in total of nozzles from among the N pieces of first nozzles and among the N pieces of second nozzles to be used for image formation in a case where the ejection quantity is equal to or greater than the first threshold; and selecting a second combination of N pieces in total of nozzles from among the N pieces of first nozzles and among the N pieces of second nozzles to be used for image formation in a case where the ejection quantity is smaller than the first threshold.

* * * * *